US007097518B2

(12) United States Patent
Kraemer et al.

(10) Patent No.: US 7,097,518 B2
(45) Date of Patent: Aug. 29, 2006

(54) CONTACT TERMINAL

(75) Inventors: Rudolf Kraemer, Lautertal (DE); Werner Tille, Stockstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/121,653

(22) Filed: May 4, 2005

(65) Prior Publication Data

US 2005/0260896 A1 Nov. 24, 2005

(30) Foreign Application Priority Data

May 4, 2004 (DE) ..... 10 2004 021 836

(51) Int. Cl.
*H01R 4/40* (2006.01)

(52) U.S. Cl. ..... 439/806; 439/864; 439/815

(58) Field of Classification Search ..... 439/806, 439/864, 815
See application file for complete search history.

(56) References Cited

U.S. PATENT DOCUMENTS 2,451,466 A * 10/1948 Bentley ..... 439/806
3,579,283 A * 5/1971 Welbum ..... 439/864
5,938,488 A 8/1999 Wilmes
6,036,532 A * 3/2000 Feistkorn ..... 439/864
6,322,400 B1 11/2001 Perry et al.

FOREIGN PATENT DOCUMENTS

| | | |
|---|---|---|
| DE | 77 08 555 | 7/1977 |
| DE | 93 17 783.6 | 2/1994 |
| DE | 196 11 854 C1 | 7/1997 |
| DE | 196 35 135 C1 | 1/1998 |
| EP | 0271594 B1 | 4/1992 |
| EP | 0 836 242 A1 | 4/1998 |
| WO | WO 2004/027935 A1 | 4/2004 |

* cited by examiner

*Primary Examiner*—Tho D. Ta
(74) *Attorney, Agent, or Firm*—Barley Snyder, LLC

(57) ABSTRACT

A contact terminal, by means of which an annular connector or two connectors may be gripped, is described. The contact terminal comprises a housing with a pivotally mounted terminal element which may be biased onto a contact face mounted on the housing at a contact region. A holding element is provided in the contact region, to prevent a connector inserted into the contact terminal from being pulled out in the lateral direction. The terminal element has a terminal face to grip the connector against the contact face.

17 Claims, 3 Drawing Sheets

CONTACT TERMINAL

FIELD OF THE INVENTION

The invention relates to a contact terminal, and more particularly to a screw terminal according to the preamble of claim 1.

BACKGROUND

Screw terminals are known in which the screw terminal comprises a terminal element by means of which a connector may be gripped against a contact associated with the terminal element. The connector may be biased against the associated contact by means the terminal element, via a screw, for example. The associated contact may, for example, comprise a flat contact plate that has the connector, which may be conducting wire, biased against it by means of the terminal element. It is further known that annular connectors may be screwed to the contact by means of a screw as the terminal element. The screw is screwed through a hole in the annular connector. Different connectors require different terminal elements.

The object of the invention is to provide a contact terminal by means of which an annular connector may be gripped. A further object of the invention is to produce a contact terminal by means of which connectors of different forms may be securely and reliably contacted by an associated contact.

SUMMARY

The object of the invention is achieved by a contact terminal having the characteristics of claim 1. This contact terminal has the advantage that annular connectors may be contacted securely and reliably. Furthermore, connectors in the form of conductive wires as well as in the form of annular connectors may be contacted securely and reliably. These advantages are achieved by providing a terminal element that may be biased against a contact face of an associated contact. The contact face comprises a holding element that protrudes from the contact face in the direction of the terminal element and secures an annular connector against extraction from the contact terminal. The holding element and the terminal element are preferably configured such that linear connectors, which are arranged to the side of the holding element, may be biased against the contact face by means of the terminal element.

Further advantageous embodiments of the invention are provided in the dependent claims.

In an exemplary embodiment of the contact face, the holding element is configured as part of the contact face and, with respect to the remainder of the contact face, protrudes in the direction toward the terminal element. The holding element preferably has an annular lateral contour by means of which, on the one hand, a large border region for seating of the annular connector is provided and, on the other hand, the adjustment of the annular connector on the contact face is made possible.

In a further embodiment of the contact terminal, the terminal element comprises a terminal region that may be biased in the direction of the contact face. A recess, which is associated with the holding element, is provided on the terminal region of the terminal element. In addition, the terminal region comprises a terminal face which is provided for gripping the connector to it and which is arranged to the side of the holding element. Secure gripping of the connector to the terminal face, independently of the shape of the connector, can thus be achieved, the holding element being associated with the recess and the holding element not resting on the terminal element or only resting with slight pressure when the connector is gripped.

Terminal faces are preferably configured on either side of the recess on the terminal region of the terminal element. Connectors can therefore be gripped at least with two terminal faces. In addition, two connectors can also be gripped simultaneously. The holding element is preferably at least partially circular or annular in shape.

In an exemplary embodiment, the terminal element, which is pivotally mounted on the housing of the contact terminal via an axis of rotation, is configured in the form of a lever arm. The lever arm comprises a seating face that is provided for the seating of a screw. The housing of the contact terminal comprises a screw thread for screwing in the screw, configured on an upper face of the contact terminal. In addition, the terminal element comprises a cam in the region of the axis of rotation, upon which a biasing means acts, which biases the terminal element against the screw.

In a further exemplary embodiment the screw thread is arranged on the same side of the contact terminal as an insertion opening, which is provided for inserting one or more contact elements into the contact terminal.

In a further exemplary embodiment the terminal element is pivotally mounted on an axis of rotation, the mounting being such that the terminal element may be tilted in the plane, which is predetermined by the axis of rotation, in a predetermined angular range. The terminal face of the terminal element can thus be arranged at a predetermined angle to the contact face of the contact. Thus, two connectors of different thickness may be biased against the contact face simultaneously with a terminal element.

In an exemplary embodiment, the tiltable mounting of the terminal element is achieved by the axis of rotation having a constant diameter and the bearing bore of the terminal element having a diameter that increases in size from the center region out toward the two openings of the bearing bore. The axis of rotation itself has a constant diameter in this embodiment. In a similar embodiment, the bearing bore may have a constant diameter and the pin that defines the axis of rotation, from a center region toward the two ends, may respectively have a decreasing diameter.

In an exemplary embodiment, the contact region is part of a contact plate which preferably has a U-shaped configuration. The contact region is arranged inside the housing of the contact terminal and the second arm or connecting region of the contact plate is arranged outside the housing. The second arm has the function of connecting a further contact. The U-shaped configuration of the contact plate is a simple and cost-effective construction of a contact terminal.

BRIEF DESCRIPTION OF THE DRAWINGS

The invention will be described hereinafter in greater detail with reference to figures, in which.

DETAILED DESCRIPTION OF THE EMBODIMENTS

Figure 1:
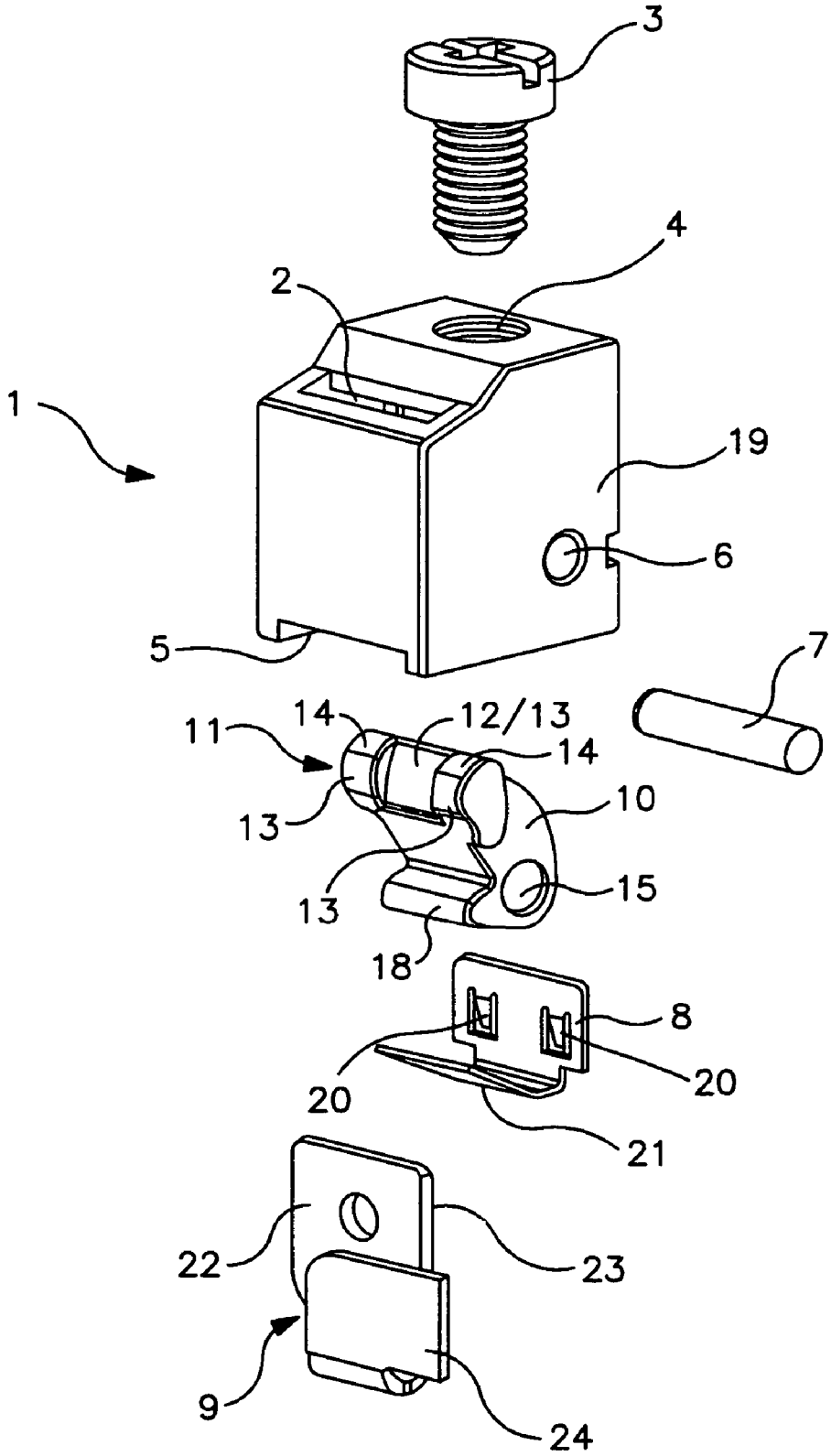
FIG. 1 is an exploded view of a contact terminal according to an exemplary embodiment of the present invention.

FIG. 1 is an exploded view of a contact terminal 1 having a housing 19, a pin 7, a screw 3, a terminal element 10, a spring plate 8 and a contact plate 9. The housing 19 comprises a tapped hole 4 on the upper side, into which the screw 3 may be screwed. A slit-shaped contact opening 2 is formed on the same side of the housing 19. Bearing bores 6 for mounting the pin 7 are provided in opposing side walls of the housing 19. In addition, the housing 19 comprises an offset 5 on a bottom lateral edge of a front wall, by which the front of the housing 19 is set back. The terminal element 10 is configured substantially in the form of a lever arm, the bottom region thereof is provided with a bearing bore 15. In the region of the bearing bore 15, a cam 18 is formed perpendicularly to the bearing bore 15 on the terminal element 10. In the upper end region the terminal element 10 comprises a terminal region 11, which has a recess 12. Two terminal faces 14 are arranged to the side of the recess 12, wherein the terminal faces 14 display rounded faces that are provided with fluting 13 and are preferably arranged at the same level on an axis parallel to the bearing bore 15. The terminal region 11 also comprises fluting 13 in the region of the recess 12.

The spring plate 8 comprises a holding region, in which two holding tabs 20 are formed. The holding region is connected to a contact region 21, wherein the holding region and the contact region 21 are arranged at an angle of <90° to each other.

The contact plate 9 has a substantially U-shaped configuration, wherein a first arm of the U-shape exhibits a contact region 22 having a contact face 23 and the second arm of the U-shape exhibits a connecting region 24.

Figure 2:
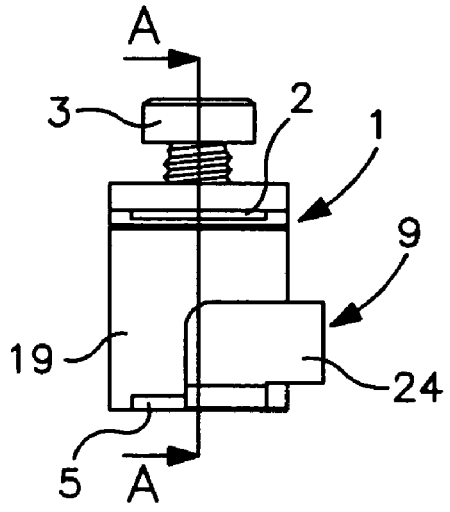
FIG. 2 is a first side view of the contact terminal of FIG. 1.

FIG. 2 shows the contact terminal 1 in the assembled state in a first side view onto the contact opening 2 and the connecting region 24 of the contact plate 9, which is arranged outside of the housing 19. The contact plate 9 is guided into the inside of the housing 19 via the offset 5. The screw 3 is screwed into the tapped hole 4 (shown in FIG. 1).

Figure 3:
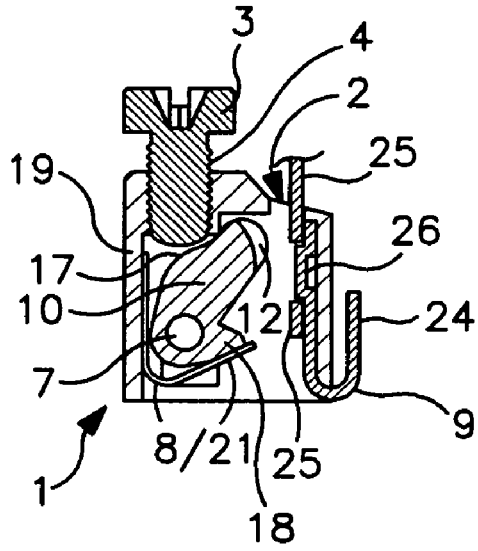
FIG. 3 is a cross-section of the contact terminal of FIGS. 1 and 2 taken along line A—A in FIG. 2.

FIG. 3 is a cross-section of the contact terminal 1. The terminal element 10 is pivotally mounted via the pin 7, which is mounted in bearing bores 6 (shown in FIG. 1), provided in opposing side walls of the housing 19. The terminal element 10 comprises a seating face 17 that is associated with the screw 3. The seating face 17 is configured in the upper region of the terminal element 10 opposing the terminal faces 14 on a back of the terminal element.

The spring plate 8 is attached to an interior back wall of the housing 19 by means of the holding tabs 20 (shown in FIG. 1), wherein the seating region 21 rests on the cam 18 of the terminal element 10 and the terminal element 10 is biased against the screw 3 at the seating face 17. Opposite the terminal element 10, the contact region 22 of the contact plate 9 is arranged on an interior front wall of the housing 19. The contact region 22 is configured substantially as a flat plate, wherein a holding element 26 protrudes in the direction of the terminal element 10 and has at least an essentially circular shaped element 26. An annular connector 25 is mounted on the holding element 26. An open annular shape or a partially annular shape may also be used for the connector instead of the closed annular shape. The annular connector 25 exhibits a hole, with which the holding element 26 engages. The screw 3 is screwed deeper into the housing 19 in order to pivot the contact element 10 to grip the annular connector 25 on the contact plate 9. The screw 3 presses onto the seating face 17 of the contact element 10 and pivots the contact element 10 comprising the terminal faces 14 and the recess 12 in the direction of the annular connector 25 and the holding element 26 against the resilience of the spring plate 8. The terminal element 10 and the holding element 26 are arranged such that the holding element 26 is associated with the recess and, when the annular connector 25 is gripped on the contact plate 9, the terminal faces 14 are arranged to the side of the holding element 26 and rest on the annular connector 25. The holding element engages with the recess 12. In the gripped position, the annular connector 25 is prevented from becoming detached from the contact terminal 1 by the holding element 26.

If the annular connector 25 is to be released from the contact terminal 1 again, the screw 3 is at least partially withdrawn from the housing 19. The terminal element 10 is consequently pivoted from the gripping position back into an open position by the spring plate 8. The annular connector 25 is released and may be lifted from the holding element 26 and pulled upward out of the contact opening 2.

Figure 4:
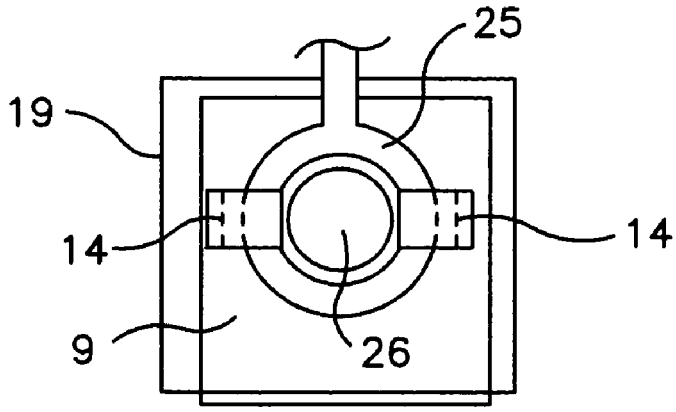
FIG. 4 is a cross-section through a terminal element of the contact terminal of FIGS. 1–3 showing a gripped annular connector.

FIG. 4 is a cross-section of the contact terminal 1, the annular connector 25 being biased against the contact face 23 by the two terminal faces 14 of the terminal element 10. In the illustrated cross-section, the terminal element 10 is cut in a plane parallel to the contact plate 9 in the region of the recess 12, such that only the two terminal faces 14 of the contact element 10 are shown. The annular connector 25 basically consists of a conductive ring. The annular connector 25 is placed on the holding element 26 and may be biased against the contact plate 9 by means of the two terminal faces 14 arranged on the side of the holding element 26.

Depending on the chosen embodiment, the holding element 26 may have arbitrary shapes that prevent lateral removal of the connector. As illustrated in FIG. 4, the holding element 26 according to one exemplary embodiment has a circular configuration, in order to perform an adjustment function for the annular connector 25 in addition to the holding function. As a result of the circular lateral contour of the holding element 26 and the circular contour of the hole of the annular connector 25, an adjustment of the annular connector 25 to the position of the holding element 26 is achieved. The diameters of the holding element 26 and the hole of the annular connector 25 may be matched to one another for that purpose. Depending on the chosen embodiment, the holding element 26 may also be configured as a part of the housing 19 which protrudes through a corresponding opening in the contact plate 9. In addition, the holding element 26 may also be configured on the terminal region 11 of the terminal element 10 instead of the recess 12 and protrude beyond the terminal faces 14 toward the contact face 23.

In a simple embodiment the terminal element 10 only comprises one terminal face 14, which is arranged to the side of the holding element 26. Depending on the chosen embodiment the recess 12 may be omitted. This is particularly the case when the height of the holding element 26, by which the holding element 26 protrudes beyond the contact face 23 or the terminal faces 14, is less than the thickness of the connector that is to be gripped, in particular the annular connector 25.

In addition, the recess 12 may be omitted if the terminal face 14 of the terminal element 10 is arranged adjacent to the holding element 26. However, the terminal element 10 preferably comprises a plurality of terminal faces 14 that are arranged in various regions to the side of the holding element 26. It is advantageous in this embodiment if the terminal faces 14 protrude beyond the terminal region 11 of the terminal element 10. Instead of the illustrated embodiment, three or four terminal faces 14 may also be provided, which are arranged in a wide variety of arrangements to the side of the holding element 26. The preferred arrangement is illustrated in FIG. 4, in which the terminal face 14 is arranged at the same level and parallel to the axis of rotation of the terminal element 10, which is determined by the pin 7.

Figure 5:
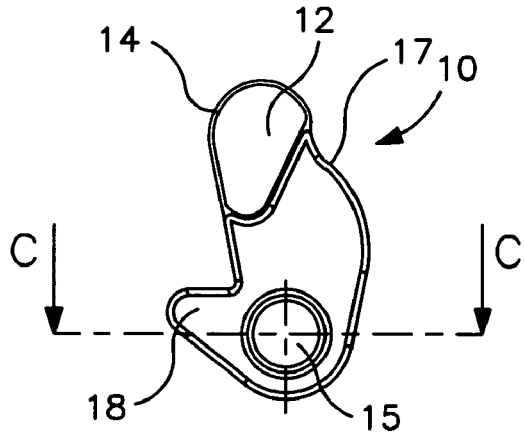
FIG. 5 is a cross-section of the terminal element of the contact terminal of FIGS. 1–3.

FIG. 5 is a cross-section of the terminal element 10 in the region of the recess 12.

Figure 6:
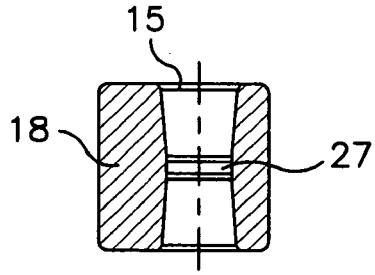
FIG. 6 is a cross-section of the bearing bore of the terminal element of FIG. 5, taken along line C—C in FIG. 5.

FIG. 6 is a cross-section C—C of FIG. 5, which extends through a center line of the bearing bore 15 and shows an exemplary embodiment of the bearing bore 15. The bearing bore 15 has a diameter, which increases in size from a center region 27 outward toward the openings of the bearing bore 15 on both sides. The bearing bore 15 thus consists of two bore portions that preferably taper toward the center region 27. Tilting of the terminal element 10 relative to the axis of rotation is made possible by the cooperation with the pin 7, which has a substantially cylindrical shape with a constant diameter. As the bearing bore 15 has a constant diameter in a predetermined portion in the center region 27, parallel mounting of the terminal element 10 in the axis of rotation is also made possible, if the terminal element 10 rests uniformly, for example on the annular connector 25, by means of the terminal faces 14, on both sides of the center region 27, as illustrated in FIG. 4. However, the double-sided conical bearing bore 15 of FIG. 6 affords the additional advantage that the terminal element 10 is tiltably mounted on both sides perpendicularly to the longitudinal axis of the terminal element 10. In a simple embodiment, the bearing bore 15 is configured in the form of a single continuously conical bore.

Figure 7:
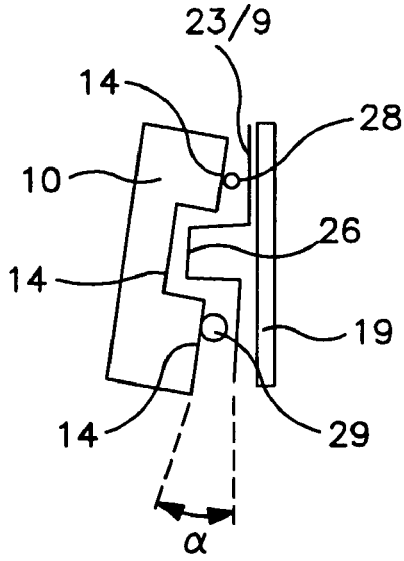
FIG. 7 is a partial cross-section of a contact terminal, which grips two conducting wires of different thickness according to an exemplary embodiment of the present invention.

FIG. 7 is a cross-section of a tiltably mounted terminal element at the level of the terminal faces 14. The cross-section is arranged parallel to the axis of rotation and perpendicular to the contact face 23. As a result of the tiltable mounting of the terminal element 10, the terminal element 10 may bias a first and a second connector 28, 29 against the contact face 23 of the contact plate 9. The two connectors 28, 29 are inserted into the contact opening 2 on opposing sides of the holding element 26 and are biased against the contact face 23 of the contact plate 9 by means of the two terminal faces 14 of the terminal element 10. The first connector 28 has a smaller thickness or diameter than the second connector 29. In this arrangement the tiltable mounting is effected in the plane of the axis of rotation of the terminal element 10, since the two terminal faces 14 may thus adopt a predetermined maximum angle $\alpha$ to the contact face 23 of the contact plate 9, as illustrated in FIG. 7.

What is claimed is:

1. A contact terminal comprising:

a housing with a pivotally mounted terminal element which may be biased onto a contact face mounted on the housing at a contact region; and a holding element provided in the contact region, to prevent a connector inserted into the contact terminal from being pulled out in the lateral direction;

the terminal element having two terminal faces arranged in a terminal region to grip the connector against the contact face wherein each terminal face projects toward the contact face, is arranged adjacent to the holding element on one axis being oriented parallel to an axis of rotation of the terminal element and biases the connector against the contact face.

2. The contact terminal according to claim 1, wherein the holding element is integral with the contact face.

3. The contact terminal according to claim 1, wherein the holding element comprises at least one partially annular side face to hold an annular connector.

4. The contact terminal according to claim 1, wherein the terminal element is mounted pivotally about the axis of rotation by bearing members.

5. A contact terminal comprising:

a housing with a pivotally mounted terminal element which may be biased onto a contact face mounted on the housing at a contact region; and a holding element provided in the contact region, to prevent a connector inserted into the contact terminal from being pulled out in the lateral direction;

the terminal element having a terminal face to grip the connector against the contact face;

wherein the terminal element is configured in the form of a lever arm which is arranged on an axis of rotation in a first end region, a seating face is provided in the opposing second end region of the terminal element, the housing comprises a tapped hole by means of which a screw that is provided for resting on the seating face may be screwed in to bias the terminal element against the contact face.

6. The contact terminal according to claim 5, wherein the holding element is integral with the contact face.

7. The contact terminal according to claim 5, wherein the holding element comprises at least one partially annular side face to hold an annular connector.

8. The contact terminal according to claim 5, wherein the terminal element, in a terminal region, comprises at least one terminal face, which projects toward the contact face, the terminal face being arranged adjacent to the holding element and biasing the connector against the contact face.

9. The contact terminal according to claim 5, wherein the terminal element is mounted pivotally about the axis of rotation by bearing members.

10. A contact terminal comprising:

a housing with a pivotally mounted terminal element which may be biased onto a contact face mounted on the housing at a contact region; and a holding element provided in the contact region, to prevent a connector inserted into the contact terminal from being pulled out in the lateral direction;

the terminal element having a terminal face to grip the connector against the contact face;

wherein a screw may be screwed into a tapped hole in the housing for adjusting the position of the terminal element, and a contact opening for the insertion of the connector is provided on the same side of the housing on which the tapped hole is arranged.

11. The contact terminal according to claim 10, wherein the holding element is integral with the contact face.

12. The contact terminal according to claim 10, wherein the holding element comprises at least one partially annular side face to hold an annular connector.

13. The contact terminal according to claim 10, wherein the terminal element, in a terminal region, comprises at least one terminal face, which projects toward the contact face, the terminal face being arranged adjacent to the holding element and biasing the connector against the contact face.

14. A contact terminal comprising:

a housing with a pivotally mounted terminal element which may be biased onto a contact face mounted on the housing at a contact region; and a holding element provided in the contact region to prevent a connector inserted into the contact terminal from being pulled out in the lateral direction;

the terminal element having a terminal face to grip the connector against the contact face wherein the terminal element is mounted pivotally about an axis of rotation by bearing members configured to allow the terminal element to tilt in the plane of the axis of rotation;

wherein the terminal element comprises a bearing bore through which a pin is guided to define an axis of rotation, the bearing bore comprising a center region having a first diameter, and two cone shaped bearing bore portions, tapering from the center region toward the openings of the bearing bore, wherein the diameters thereof increase toward the ends of the bearing bore.

15. The contact terminal according to claim 14, wherein the holding element is integral with the contact face.

16. The contact terminal according to claim 14, wherein the holding element comprises at least one partially annular side face to hold an annular connector.

17. The contact terminal according to claim 14, wherein the terminal element, in a terminal region, comprises at least one terminal face, which projects toward the contact face, the terminal face being arranged adjacent to the holding element and biasing the connector against the contact face.

* * * * *